US008246484B2

(12) United States Patent
Sato et al.

(10) Patent No.: US 8,246,484 B2
(45) Date of Patent: Aug. 21, 2012

(54) GOLF CLUB, HEAD OF GOLF CLUB AND METHOD FOR ADJUSTING PROPERTIES OF GOLF CLUB

(75) Inventors: Fumiaki Sato, Chichibu (JP); Hiroshi Takahashi, Chichibu (JP); Hideo Matsunaga, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 254 days.

(21) Appl. No.: 12/646,056

(22) Filed: Dec. 23, 2009

(65) Prior Publication Data

US 2010/0317454 A1 Dec. 16, 2010

(30) Foreign Application Priority Data

Jun. 15, 2009 (JP) ..... 2009-142316

(51) Int. Cl.
*A63B 53/02* (2006.01)

(52) U.S. Cl. ..... 473/307; 473/288; 473/309; 473/246

(58) Field of Classification Search ..... 473/288, 473/307, 309–310, 244–248
See application file for complete search history.

(56) References Cited

U.S. PATENT DOCUMENTS

| | | | | |
|---|---|---|---|---|
| 5,951,411 | A * | 9/1999 | Wood et al. | 473/307 |
| 7,335,113 | B2 * | 2/2008 | Hocknell et al. | 473/307 |
| 7,476,160 | B2 * | 1/2009 | Hocknell et al. | 473/307 |
| 7,931,542 | B2 * | 4/2011 | Kusumoto | 473/288 |
| 2006/0264266 | A1 * | 11/2006 | Jung | 473/282 |
| 2009/0286611 | A1 * | 11/2009 | Beach et al. | 473/246 |
| 2009/0286619 | A1 * | 11/2009 | Beach et al. | 473/324 |
| 2010/0035701 | A1 * | 2/2010 | Kusumoto | 473/307 |

FOREIGN PATENT DOCUMENTS

| | | | |
|---|---|---|---|
| JP | 11-178954 | A | 7/1999 |
| JP | 2000-5349 | A | 1/2000 |
| JP | 2003-70940 | A | 3/2003 |

* cited by examiner

*Primary Examiner* — Stephen L. Blau
(74) *Attorney, Agent, or Firm* — Sughrue Mion, PLLC

(57) ABSTRACT

A golf club head with a leading end of a shaft mountable thereon, the golf club head includes: a head main body, formed with a hosel insertion hole; a hosel, formed with a shaft case insertion hole and removably mounted in the hosel insertion hole; and a shaft case, formed with a shaft insertion hole and removably mounted in the shaft case insertion hole.

12 Claims, 10 Drawing Sheets

GOLF CLUB, HEAD OF GOLF CLUB AND METHOD FOR ADJUSTING PROPERTIES OF GOLF CLUB

BACKGROUND

1. Field of the Invention

The present invention relates to a golf club. Specifically, the invention relates to a golf club and a head of such golf club the properties of which, such as the lie angle, slice angle and goose can be adjusted easily. Also, the invention relates to a method for adjusting the properties of such golf club.

2. Description of the Related Art

A golf club is structured such that a head is mounted on the leading end portion of a shaft, while a grip is mounted on the base end portion of the shaft.

Referring to the structure of a conventional ordinary golf club head, a hosel hole is formed directly in the head, while the shaft is inserted into the hosel hole and is fixed thereto using an adhesive agent. Here, as the adhesive agent, generally, there is used an epoxy-system adhesive agent. To replace the shaft, the hosel portion of the head may be heated to destroy the structure thereof that is formed of the hardened epoxy resin of the adhesive agent, whereby the shaft can be then pulled out of the hosel portion of the head.

In JP-A-11-178954, there is disclosed a golf club head structured such that a head main body and a hosel are formed separately from each other and the hosel is fixed to the head main body using a screw. In JP-A-11-178954, a plate-shaped neck portion is formed on the lower end side of the hosel, and the neck portion is inserted into the insertion portion of the head main body and is fixed thereto using a screw. Thus, since the plate-shaped neck portion is fixed to the head main body in this manner, in the impact time when a golfer hits a ball with the head, the neck portion is allowed to bend, thereby relieving the concentration of stresses occurring in the connecting portion between the shaft and hosel.

In the golf club head disclosed in JP-A-11-178954, the lie angle, slice angle and the like of the head cannot be adjusted. Also, since the connecting strength between the head main body and hosel as well as the rigidity of the head are both insufficient, the golf club head cannot provide a strong impact feeling. Also, the position of the hosel is excessively high.

SUMMARY

The invention aims at solving the problems found in the above-mentioned conventional golf club head. Thus, it is an object of the invention to provide a golf club and a head of such golf club the properties of which, such as the lie angle, slice angle and goose can be adjusted, as well as a method for adjusting such properties.

According to a first aspect of the invention, there is provided a golf club head with a leading end of a shaft mountable thereon, the golf club head including: a head main body, formed with a hosel insertion hole; a hosel, formed with a shaft case insertion hole and removably mounted in the hosel insertion hole; and a shaft case, formed with a shaft insertion hole and removably mounted in the shaft case insertion hole.

According to a second aspect of the invention, there is provided a golf club, including: a golf club head including: a head main body, formed with a hosel insertion hole; a hosel, formed with a shaft case insertion hole and removably mounted in the hosel insertion hole; and a shaft case, formed with a shaft insertion hole and removably mounted in the shaft case insertion hole; and a shaft, wherein a leading end of the shaft is inserted into and fixed to the shaft insertion hole.

The shaft may be set concentric with the shaft case insertion hole.

The shaft may be set concentric with the hosel insertion hole.

An axis of the shaft may be inclined with respect to an axis of the hosel insertion hole.

An axis of the shaft may be parallel to an axis of the hosel insertion hole and may be separated from the axis of the hosel insertion hole.

The above golf club may include: a first female screw, formed in an inner peripheral surface of an entrance portion of the hosel insertion hole; a first screw member; a first male screw, formed in an outer peripheral surface of the first screw member, the first male screw being fitted with an outer surface of the hosel so that the first screw member is rotatably attached and is prevented from moving in an axial direction of the first screw member, wherein the first male screw is threadedly engaged with the first female screw to fix the hosel to the head main body.

The above golf club may include: a second female screw, formed in an inner peripheral surface of an entrance portion of the shaft case insertion hole; a second screw member; a second male screw, formed in an outer peripheral surface of the second screw member, a second screw member being fitted with an outer surface of the shaft case so that the second screw member is rotatably attached and is prevented from moving in an axial direction of the second screw member, wherein the second male screw is threadedly engaged with the second female screw to fix the shaft case to the hosel.

The above golf club may include: a first female screw, formed in an inner peripheral surface of an entrance portion of the hosel insertion hole; a first screw member; a first male screw, formed in an outer peripheral surface of the first screw member, the first male screw being fitted with the outer surface of the shaft case so that the first screw member is rotatably attached and is prevented from moving in an axial direction of the first screw member, wherein the first male screw is threadedly engaged with the first female screw to fix the hosel to the head main body.

The above golf club may include: a second female screw, formed in an inner peripheral surface of an upper portion of the first screw member, a second screw member; a second male screw, formed in an outer peripheral surface of the second screw member, the second male screw being fitted with an outer surface of the shaft case so that the second screw member is rotatably attached and is prevented from moving in an axial direction of the second screw member, wherein the second male screw is threadedly engaged with the second female screw to fix the shaft case to the hosel.

The shaft is inserted into the shaft insertion hole of the shaft case and is fixed with an adhesive agent.

A lower end portion of the hosel may have a polygonal-shaped section, and the deep portion of the hosel insertion hole may have a section adapted to engage with the lower end portion of the hosel.

The above golf club may include an elastic member, interposed between the lower end portion of the hosel and an inner surface of the deep portion of the hosel insertion hole.

According to a third aspect of the invention, there is provided a method for adjusting a property of the golf club according to the second aspect, including: separating the hosel from the hosel insertion hole and shaft case; replacing the hosel with another hosel different therefrom in a position or an angle of the shaft case insertion hole; and fixing the shaft case to the shaft insertion hole; and fixing the hosel to the hosel insertion hole.

According to a fourth aspect of the invention, there is provided a method for adjusting a property of the golf club according to the second aspect, including: fixing a new shaft to a new shaft case to form a connected unit; removing the shaft case and the shaft from the head; and mounting the connected unit onto the head.

In a golf club and a head of such golf club according to the invention, the hosel is removably mounted on the head main body and, on the hosel, there is removably mounted the shaft case; and, the hosel can be removed from the hosel insertion hole of the head main body and also the shaft case can be removed from the shaft case insertion hole of the hosel. Therefore, by replacing this hosel with other hosel which is different from the former hosel in the lie angle, slice angle or goose, or by changing the peripheral direction phase of the hosel, the shaft case with a shaft connected thereto can be mounted again onto the head main body through the hosel.

For example, by replacing the existing hosel with a new hosel in which the axis of a shaft is set in a direction oblique to the axis of the hosel insertion hole (for example, in an obliquely crossing direction), the mounting direction of the shaft on the head main body can be changed, whereby the lie angle and slice angle of the hosel can be changed.

Therefore, in a golf club including the same shaft and the same head main body, only the lie angle or slice angle can be adjusted.

Also, by replacing the existing hosel with a new hosel in which the position of the shaft case insertion hole is shifted from the axial position of the hosel insertion hole in a parallel translation manner, in a golf club including the same shaft and the same head main body, the goose and the distance between the shaft and the center of gravity (gravity distance) of the golf club can be adjusted.

Here, according to the invention, the hosel may not be replaced but the shaft with a shaft case connected thereto may be replaced, thereby being able to replace the shaft. That is, as a shaft case, there may be previously prepared entirely the same type of shaft case as the existing shaft case. And, a shaft different in properties from the existing shaft may be previously fixed to the thus prepared shaft case to thereby provide a new shaft case/shaft connected unit. The existing head shaft case/shaft connected unit may be replaced with the new shaft case/shaft connected unit, and the new shaft case/shaft connected unit may be mounted onto the hosel of the head. In this manner, there can be obtained a golf club in which only the shaft is different.

According to this shaft replacing method, it is possible to omit a conventional troublesome labor and time requiring operation in which the adhesive agent is heated to destroy the structure of the adhesive agent, an existing shaft is removed from the head main body, and a new shaft is then mounted again onto the head main body. Thus, a shaft case/shaft connected unit can be removed from the head of a golf club just after it is used for a ball hitting try, and another new shaft case/shaft connected unit having different properties can be mounted quickly onto the same head, so that a golfer can make another try immediately. Therefore, in a golf shop and the like, it is very easy for the golfer to find a proper golf club. Also, the evaluation of the shaft can be carried out regardless of the difference between individual heads.

Recently, in order for a golfer to be able to find a golf club proper for the skill level of the golfer, there has been developed a system by which the golfer can find a golf club proper for the golfer using a computer, a high speed camera and the like. In this system, individual commercial golf clubs are used for a trial and are compared with each other according to the head speeds and ball hitting angles of the golf clubs to thereby be able to find a proper one.

On the other hand, according to a golf club of the invention, only the position relationship between the same shaft and head is changed to thereby change the gravity distance and progression, whereby a golfer can easily realize the difference in the flying properties (the hitting angle and spin) of the ball hit out between the respective changed positions of the same shaft and head easily. Also, by replacing only the shaft for the same head, the golfer can realize the difference between only the shafts. Also, according to the physical condition of a golfer on the day of play, the golfer can replace the shaft; and, while the same shaft is used but, in order to adjust the lie angle, slice angle and goose of the shaft, the golfer can change the mounting direction of the shaft onto the head.

Here, when the lower end portion of the hosel and the deep portion of the hosel insertion hole are respectively formed to have a polygonal section shape, the positioning (phase determination) of the hosel in the peripheral direction thereof can be carried out. Also, rotation between the head and hosel can be prevented.

When an elastic member is interposed between the lower end of the hosel and the inner surface of the deep portion of the hosel insertion hole, there can be absorbed impacts and vibrations which are caused between the hosel insertion hole and hosel.

BRIEF DESCRIPTION OF THE DRAWINGS

The present invention will become more fully understood from the detailed description given hereinbelow and the accompanying drawing which is given by way of illustration only, and thus is not limitative of the present invention and wherein.

DETAILED DESCRIPTION OF THE INVENTION

Figure 1:
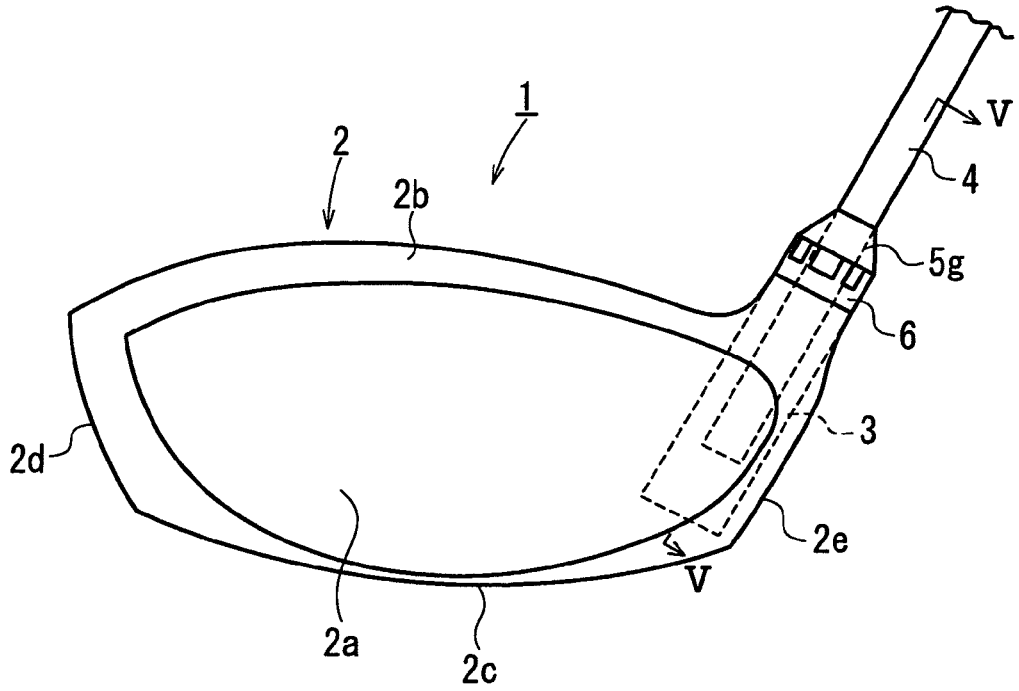
FIG. 1 is a front view of a golf club head according to an embodiment of the invention.
Figure 2:
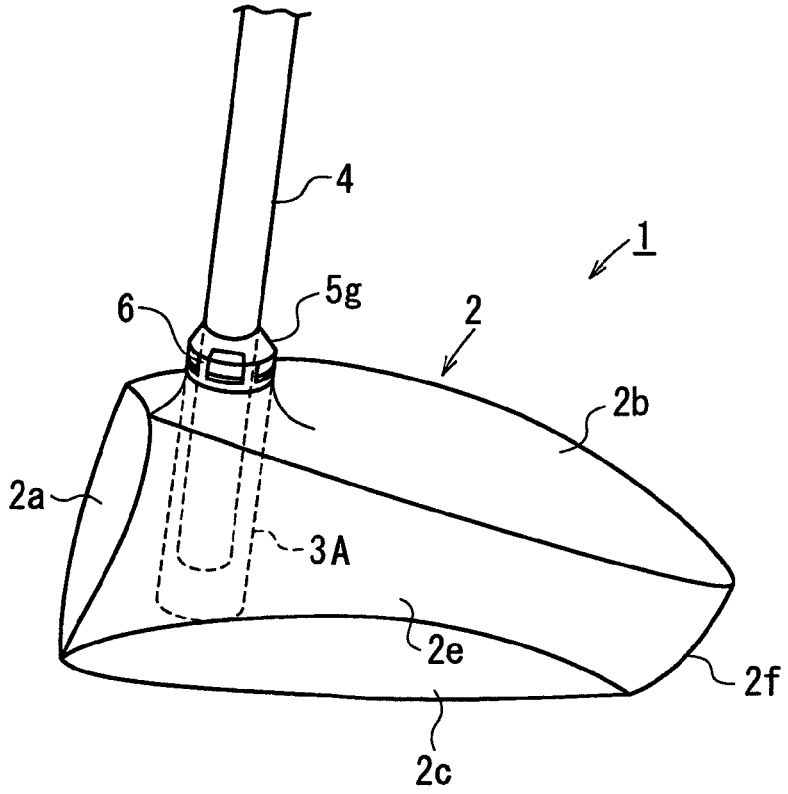
FIG. 2 is a side view of a golf club head in which the axis of a shaft is set eccentric to the axis of a hosel.
Figure 3:
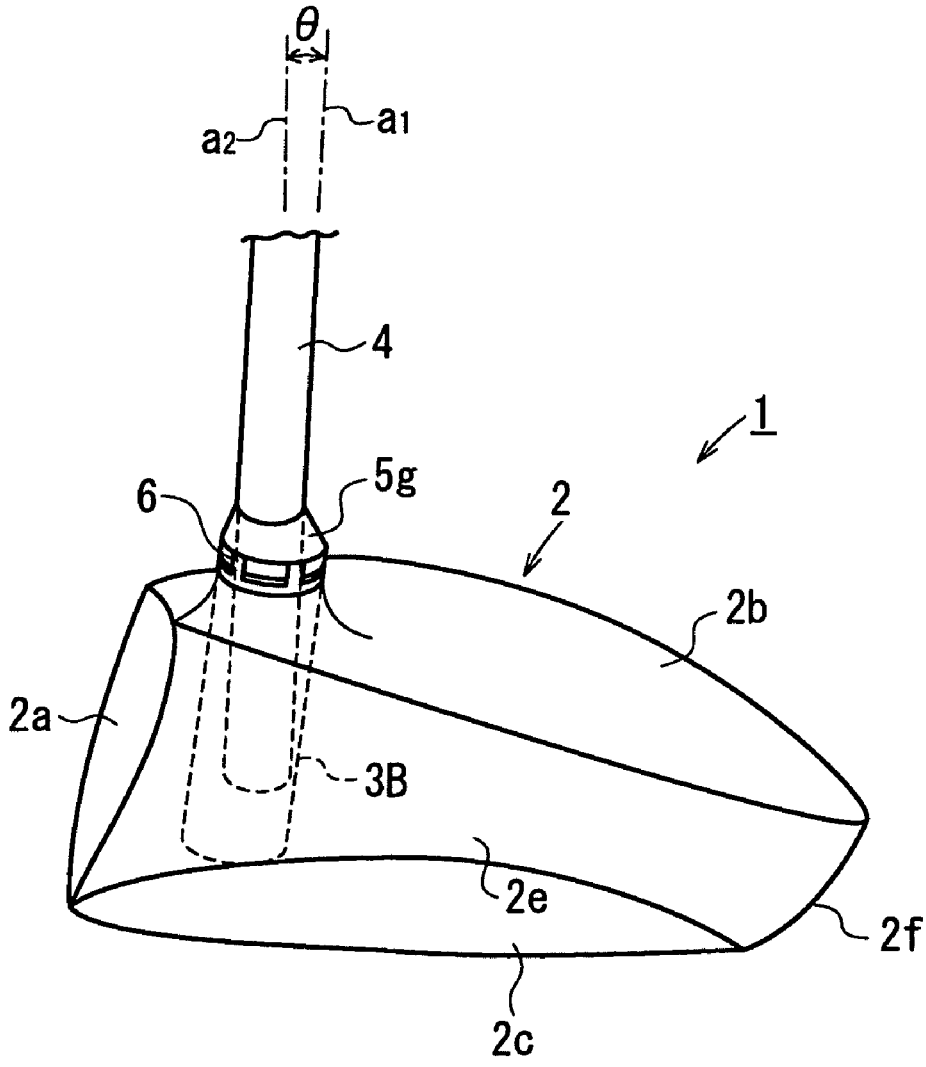
FIG. 3 is a side view of the golf club head in which the inclining direction of the shaft is changed.

Now, description will be given below of an embodiment according to the invention with reference to the accompanying drawings. Specifically, FIG. 1 is a front view of a golf club head according to the embodiment of the invention. FIGS. 2 and 3 are respectively side views of a golf club in which a hosel shown in FIG. 1 is removed from the head and new hosels are respectively mounted again onto the head. FIG. 4 is a front view of the golf club head in which the hosel shown in FIG. 1 is removed from the head and the new hosel is mounted again onto the head. FIG. 5 is a section view taken along the V-V arrow line shown in FIG. 1. FIG. 6 is a perspective view of the hosel, shaft case, screw member and the leading end portion of the shaft.

Firstly, description will be given below of a golf club head using a hosel 3 with reference to FIGS. 1, 5 and 6.

The present golf club is structured such that a shaft case 5 with a shaft 4 connected thereto is mounted through a second screw member 6 on a hosel 3 removably mounted on a head 1.

This head 1 includes a head main body 2 and a hosel 3 removably mounted on the head main body 2. Specifically, the head 1 is a hollow wood type head; and, it includes a face portion 2*a*, a crown portion 2*b*, a sole portion 2*c*, a toe portion 2*d*, a heel portion 2*e* and a back portion 2*f*.

As shown in FIG. 5, in such portion of the crown portion 2*b* as exists on the face portion 2*a* side and heel portion 2*e* side, there is formed a cylindrical hosel installation portion 2*g* having a hosel insertion hole 2H. The cylindrical hosel installation portion 2*g* includes an open upper end and a cylindrical closed lower end, while the hosel installation portion 2*g* extends in the insertion direction of the shaft 4. In such inner peripheral surface of the hosel insertion hole 2H as exists on the entrance side thereof, there is formed a female screw 2*m*. In such portion of the hosel insertion hole 2H as exists slightly more deeply of the female screw 2*m*, there is formed a step surface 2*s* which extends in the decreasing diameter direction of the hosel insertion hole 2H. In such portion of the hosel insertion hole 2H as exists more deeply of the step surface 2*s*, there is formed a cylindrical surface which continues with the step surface 2*s*.

Such inner peripheral surface of the hosel insertion hole 2H as exists more deeply of the cylindrical surface thereof is formed to have a regular square pyramid shape the diameter of which decreases toward the deeper side thereof; and, in this inner peripheral surface, there are formed four inclined surfaces 2*k* (FIG. 5) which obliquely cross the axis of the hosel 3. The two mutually opposed inclined surfaces 2*k* may preferably have a crossing angle (nipping angle) of about 10 to 30°, more preferably, about 15 to 20°.

When the hosel 3 is inserted into the hosel insertion hole 2H from above and a first screw member 9 is screwed into the female screw 2*m*, the hosel 3 can be fixed to the hosel installation portion 2*g*.

As shown in FIGS. 5 and 6, the hosel 3 has a substantially cylindrical shape including a shaft case insertion hole 3H which is formed to extend in the axial direction of the hosel 3 from the upper end thereof toward the lower end thereof.

The outer surface of the lower end portion of the hosel 3 has a square pyramid shape (exactly, a truncated square pyramid shape) the diameter of which decreases toward the lower end thereof, while this outer surface includes four inclined surfaces 3*k*. The inclined surfaces 3*k* are disposed symmetrically with the axis of the hosel 3 between them. The mutually opposed inclined surfaces 3*k* and 3*k* has the same crossing angle as the crossing angle of the deepest portion inclined surfaces 2*k* and 2*k* of the hosel insertion hole 2H. An elastic member 8A is interposed between the inclined surface 3*k* of the hosel 3 and the inclined surface 2*k* of the hosel insertion hole 2H, thereby preventing the hosel 3 from being shaken with respect to the hosel insertion hole 2H.

Although, in the present embodiment, the outer peripheral surface of the lower portion of the hosel 3 has a regular square pyramid shape, it may also have a regular polygonal pyramid shape such as a regular triangular pyramid shape, a regular hexagonal pyramid shape, or a regular octagonal pyramid shape.

On the entrance side of the shaft case insertion hole 3H, that is, in the inner peripheral surface of the upper portion of the hosel 3, there is formed a female screw 3*a*. In the present embodiment, into this female screw 3*a*, there is there is threadedly engaged a second screw member 6 which will be discussed later.

Continuously with the female screw 3*a*, there is formed a step surface 3*b* in the decreasing diameter direction of the shaft case insertion hole 3H and, more deeply of the step surface 3*b*, there is formed a cylindrical surface. The inner surface of such portion of the shaft case insertion hole 3H as exists more deeply of the cylindrical surface is formed to have a regular square pyramid shape the diameter of which decreases toward the deep side thereof and also which includes four inclined surfaces 3*d* (FIG. 5) respectively crossing the axis of the hosel 3 obliquely. The mutually opposed inclined surfaces 3*d* and 3*d* may preferably have a crossing angle (biting angle) of about 10 to 30° between them, more preferably, about 15 to 20°.

In the upper-most portion of the outer peripheral surface of the hosel 3, there is formed an increasing diameter portion 3*g* and, slightly (for example, 5 to 20 mm) downwardly of the increasing diameter portion 3*g*, there is provided a projecting portion 3*t*. The increasing diameter portion 3*g* and projecting portion 3*t* respectively extend around the hosel 3. The outer peripheral surface of the increasing diameter portion 3*g* is formed to have a taper shape the diameter of which decreases toward the upper end thereof. Between the increasing diameter portion 3*g* and projecting portion 3*t*, there is interposed the first screw member 9 in such a manner that it can be rotated in the peripheral direction thereof.

The first screw member 9 has a substantially ring shape. As shown in FIG. 6, the lower half portion of the first screw member 9 is formed slightly smaller in diameter than the upper half portion 9*a* thereof and, on the outer peripheral surface of the lower half portion, there is formed a male screw 9*b*. As shown in FIG. 6, in the outer peripheral surface of the upper half portion 9*a*, there are formed multiple recessed portions 9*e*, thereby providing a nut-like shape. When a tool is engaged with the recessed portions 9*e*, the screw member 9 can be rotated using the tool. Between the upper end face of the screw member 9 and increasing diameter portion 3*g* as well as between the lower end face of the screw member 9 and projecting portion 3*t*, there are interposed spacers 9*f* respectively.

The shaft case 5 is a cylindrical member having a shape which allows it to be fitted with the inner surface of the shaft case insertion hole 3H of the hosel 3. The shaft case 5 includes a shaft insertion hole 5H which extends in the axial direction of the shaft case 5 from the upper end toward the lower end and also into which the shaft 4 can be inserted. The outer peripheral surface of the shaft case 5 is cylindrical except for the upper end portion and lower portion thereof. The inner peripheral surface of the shaft insertion hole 5H is also cylindrical except for the lower portion thereof.

The outside diameter of the shaft case 5 may preferably be about 12 to 20 mm, more preferably, about 13 to 15 mm, while the inside diameter of the shaft case insertion hole 5H may preferably be 8 to 10 mm, more preferably, about 8.5 to 9.5 mm.

The outside diameter of the hosel 3 may preferably be about 13 to 20 mm, more preferably, about 15 to 19 mm.

In the shaft case 5, there is formed a small hole 5*b* for air bleeding which extends from the deep bottom surface of the shaft insertion hole 5H to the lower end face of the shaft case 5. The leading end of the shaft 4 is inserted into the shaft insertion hole 5H and is fixed thereto using an adhesive agent, thereby connecting together the shaft 4 and shaft case 5 as an integral body and thus providing a shaft case/shaft connected unit previously. Preferably, the adhesive agent may be applied to the outer peripheral surface of the leading end portion of the shaft 4, and the leading end portion of the shaft 4 may be then inserted into the deepest portion of the shaft insertion hole 5H. As the adhesive agent, preferably, there may be used an epoxy-system adhesive agent. Since the small hole 5*b* is formed in the shaft case 5, when the shaft 4 is inserted into the shaft insertion hole 5H, the air is allowed to flow out through the small hole 5*b*.

On the outer peripheral surface of the middle portion of the shaft case 5 in the axial direction (longitudinal direction) thereof, there is provided a projecting portion 5*t*. According to the present embodiment, the projecting portion 5*t* is formed as a flange-like portion which extends around the shaft case 5. The projecting portion 5*t* has a diameter which allows the projecting portion 5*t* to come into contact with the step surface 3*b* from above.

The outer surface of the lower end portion of the shaft case 5 is formed to have a square pyramid shape (exactly, a truncated square pyramid shape) the diameter of which decreases toward the lower end thereof, while such outer surface includes four inclined surfaces 5*c*. The inclined surfaces 5*c* are formed symmetrically with the axis of the shaft case 5 between them. The mutually opposed inclined surfaces 5*c* and 5*c* has a crossing angle between them, while the crossing angle is the same as the crossing angle between the inclined surfaces 3*d* and 3*d* of the hosel 3. The size of the inclined surface 5*c* of the shaft case 5 may be set equal to that of the inclined surface 3*d* of the hosel 3, or when an elastic member is interposed between the inclined surfaces 5*c* and 3*d*, it may be set slightly smaller. Here, the lower end portion of the shaft case 5 may also have a V-like shape including two inclined surfaces like a minus driver or other shapes having a non-circular section.

On the upper end portion of the shaft case 5, there is provided integrally therewith an increasing diameter portion 5*g* which includes a taper-shaped outer peripheral surface and decreases in diameter as it goes upwardly. The increasing diameter portion 5*g* has a truncated cone shape and includes a shaft insertion hole 5H formed in the upper surface thereof. The lower surface of the increasing diameter portion 5*g* is superimposed on top of the upper surface of a second screw member 6 through a spacer 6*f* (FIG. 5).

The second screw member 6 is rotatably fitted with the outer surface of a small diameter portion 5*h* (FIG. 5) intervening between the increasing diameter portion 5*g* and projecting portion 5*t* of the shaft case 5. The lower end face of the second screw member 6 is contacted with the projecting portion 5*t* through a spacer 6*h*.

Here, although not shown, the inner peripheral edge of the upper end side of the shaft insertion hole 5H may also be chamfered at an angle of about 20 to 45° in order to facilitate the insertion of the shaft 4 into the shaft insertion hole 5H.

As shown in FIG. 6 clearly, the second screw member 6 has a substantially ring-like shape, while the lower half portion of the second screw member 6 is formed smaller in diameter than the upper half portion 6*a* of the second screw member 6 and includes a male screw 6*b* formed in the outer peripheral surface thereof. In the outer peripheral surface of the upper half portion 6*a*, there are formed multiple recessed portions 6*e*, whereby the upper half portion 6*a* has a nut-like shape. With a tool applied to the recessed portions 6*e*, the second screw member 6 can be rotated using the tool.

To assemble the golf club, as shown in FIG. 6, firstly, the hosel 3 is inserted into the hosel insertion hole 2H of the head main body 2 and the male screw 9*b* of the first screw member 9 is screwed into the female screw 2*m* to thereby fix the hosel 3 to the head main body 2.

The shaft case 5 of the shaft case/shaft connected unit, in which the shaft case 5 is fixed to the leading end of the shaft 4, is inserted into the shaft case insertion hole 3H. Here, in the present embodiment, the thin-piece-shaped elastic member 8 such as a thin rubber member (for example, a thin rubber piece or a thin elastomer having a thickness of about 0.5 to 5 mm) has been previously mounted on the inclined surface 5*c* of the shaft case 5 and the leading end face of the shaft case 5 by daubing, by pasting or by similar means. The elastic member 8 may also have been previously mounted on the shaft case 5 or may also be mounted onto the shaft case 5 after the shaft case/shaft connected unit is formed.

The shaft case 5 of the shaft case/shaft connected unit is inserted into the shaft case insertion hole 3H in such a manner that the inclined surfaces 5*c* and 3*d* are superimposed on top of each other and, after then, the male screw 6*b* of the second screw member 6 is threadedly engaged into the female screw 3*a* formed in the upper inner peripheral surface of the shaft insertion hole 3H.

Thus, as shown in FIG. 5, the lower end face of the second screw member 6 is pressed against the projecting portion 5*t* of the shaft case 5 and the inclined surfaces 5*c* of the shaft case 5 are pressed against the inclined surfaces 3*d* of the hosel 3 respectively, thereby fixing the shaft case 5 to the hosel 3. This completes the assembly of the golf club in which the shaft 4 and head 1 are formed as an integral body, because the shaft case 5 and shaft 4 are firmly bonded to each other with the adhesive agent.

Here, in FIGS. 1, 5 and 6, the shaft 4 is disposed coaxially with the axis of the hosel insertion hole 2H. As shown in FIGS. 2 to 4B, 7 and 8 which will be respectively discussed later, the position and inclining direction of the shaft 4 can be changed.

According to the present embodiment, the hosel 3 can be replaced with another hosel in which a shaft case insertion hole is formed eccentric or is inclined. Examples of such replacing hosels are shown in FIGS. 7 and 8 respectively.

Figure 7:
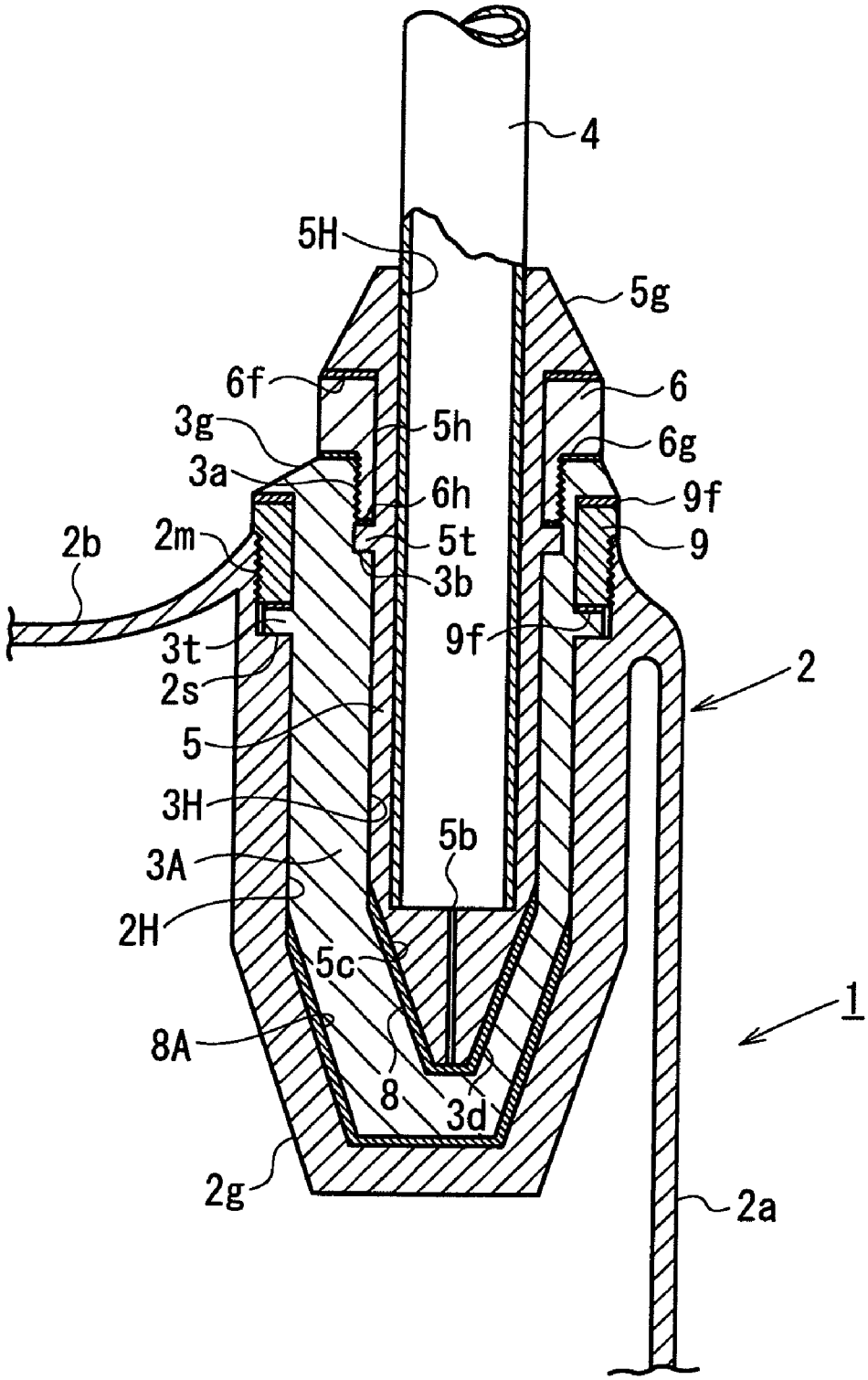
FIG. 7 is a section view of the hosel portion of the golf club head shown in FIG. 2.
Figure 8:
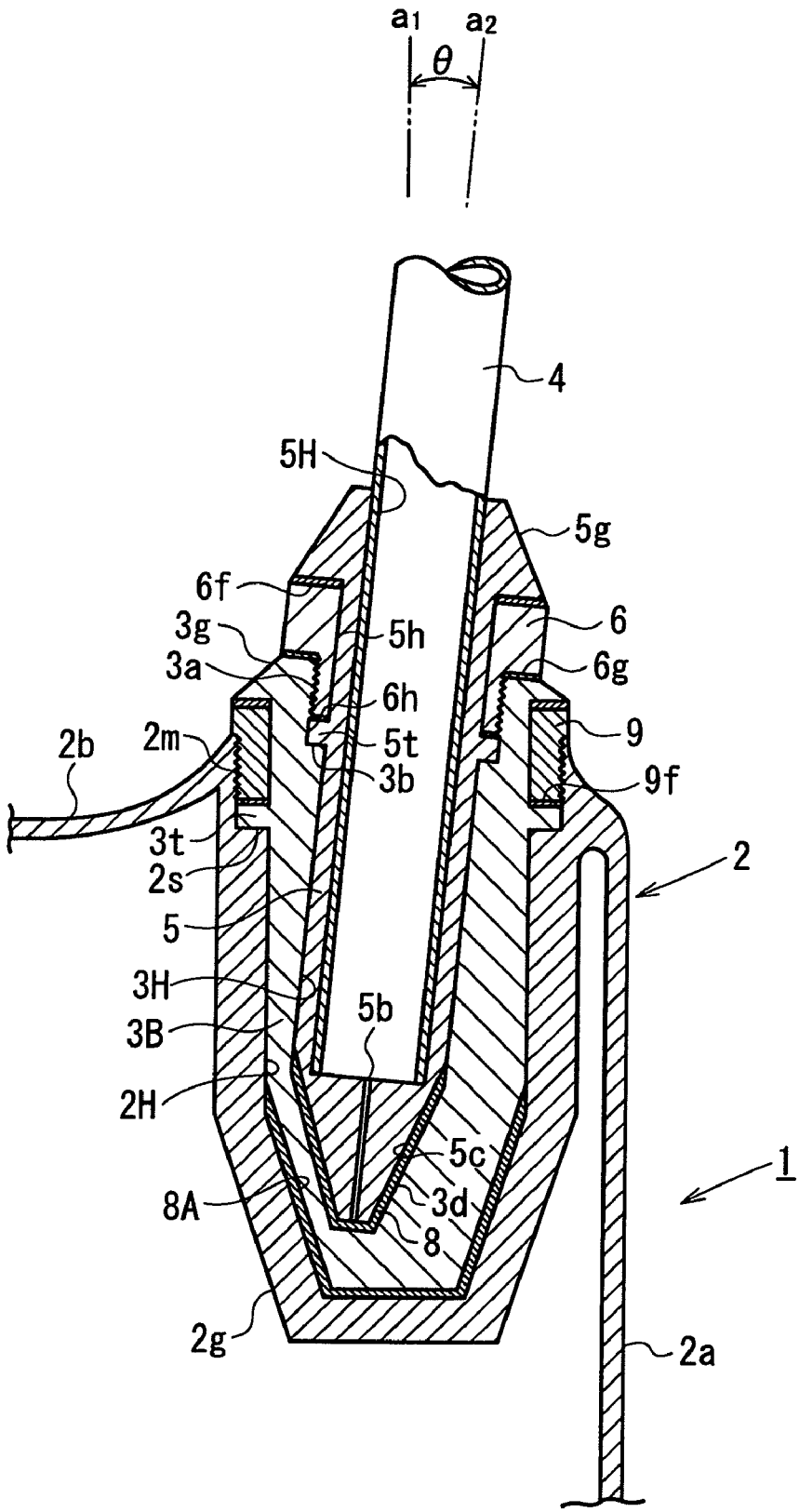
FIG. 8 is a section view of the hosel portion of the golf club head shown in FIG. 3.

In FIGS. 2 and 7, there is shown a hosel 3A structured such that a shaft case insertion hole 3H is shifted from (is set eccentric to) the axial position of the hosel 3A. The axis of the shaft case insertion hole 3H is formed parallel to and slightly (for example, 0.5 to 4.0 mm) spaced from the axes of the hosel A and hosel insertion hole 2H.

A hosel 3B shown in FIGS. 3, 4A, 4B and 8 is structured such that the axial direction of the shaft case insertion hole 3H is inclined with respect to the axial directions of the hosel 3B and hosel insertion hole 2H.

According to this embodiment, the axial line $a_2$ of the shaft case insertion hole 3H obliquely crosses the axial lines $a_1$ of the hosel insertion hole 2H and the outer peripheral surface of the hosel 3B. A crossing angle θ (FIG. 8) between the axial lines $a_1$ and $a_2$ may preferably be approximately 0.1 to 5.0°, more preferably, approximately 0.25 to 3.0°.

Here, the axial lines $a_1$ and $a_2$ may not cross each other but may be twisted with respect to each other. That is, the axial lines $a_1$ and $a_2$ may not cross each other but the axial line $a_2$ may pass by the neighborhood of the axial line $a_1$. In this case, for the angles of the axial lines $a_1$ and $a_2$, the axial line $a_2$ may be inclined most toward the heel side of the golf club head, there may be assumed a surface which contains the axial line $a_1$ and extends in the ball flying direction, and a crossing angle between such surface and the axial line $a_2$ may be set in the range of the above angle θ.

To remove the hosel 3, 3A or 3B from this golf club, the first screw member 9 may be turned in its loosening direction. Since the male screw 9*b* of the screw member 9 is threadedly engaged with the female screw 2*m* of the hosel insertion hole 2H, when the screw member 9 turns in the loosening direction, the screw member 9 moves (threadedly moves) upwardly to push up the increasing diameter portion 3*g*, whereby the hosel 3, 3A or 3B is moved upwardly. As a result of this, the hosel 3, 3A or 3B is moved in the upward direction where it can be removed from the hosel insertion hole 2H, and thus the hosel can be removed easily.

To remove the shaft case 5 from the hosel 3, 3A or 3B, the second screw member 6 may be rotated in its loosening direction. Since the male screw 6*b* of the screw member 6 is threadedly engaged with the female screw 3*a* of the hosel 3, 3A or 3B, when the screw member 6 rotates in the loosening direction, the screw member 6 moves (threadedly moves) upwardly to push up the increasing diameter portion 5*g*, whereby the shaft case 5 is moved upwardly. As a result of this, the shaft case 5 moves in the upward direction where it can be removed from the hosel 3, 3A or 3B, and thus the shaft case 5 can be removed easily.

When the hosel 3 is replaced with the hosel 3A shown in FIG. 7 or the hosel 3B shown in FIG. 8, the goose, lie angle and the like of the shaft can be adjusted.

When there is used the hosel 3A in which the shaft case insertion hole 3H is formed eccentric, as shown in FIG. 7, the shaft 4 can be made to approach the face side by an amount equivalent to the degree of such eccentric distance when compared with the state shown in FIG. 5. In FIG. 2, there is shown the side view of substantially the whole structure of the golf club shown in FIG. 7.

When the hosel 3A is removed once from the hosel insertion hole 2H in the state shown in FIGS. 2 and 7 and is turned 90°, 180° or 270°, the position of the shaft 4 can be changed to the heel side, back side or toe side in a parallel translation manner. In FIG. 2, the goose of the shaft 4 is smallest and, in a state where the hosel 3A is turned 180° from the state shown in FIG. 2, the goose becomes largest. By setting the position of the shaft 4 on the toe side or heel side, the distance between the axis of the shaft and the center of gravity of the head can be changed.

Figure 4A:
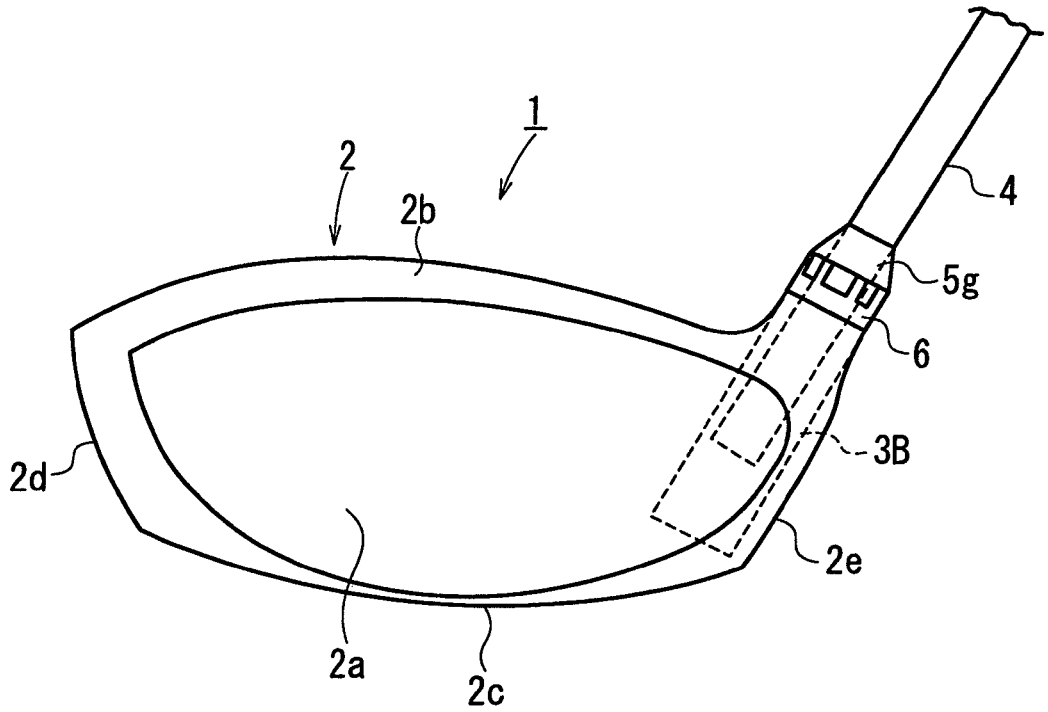
FIGS. 4A and 4B are front views of the head in which the inclining direction of the shaft is changed.
Figure 4B:
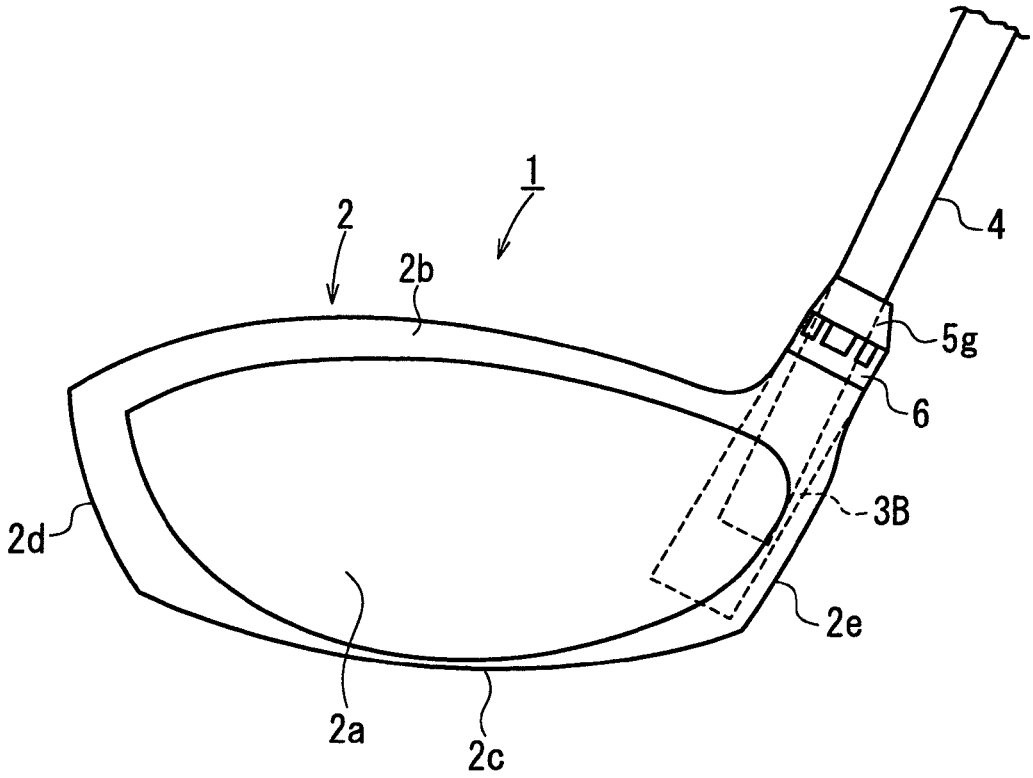
Figure 5:
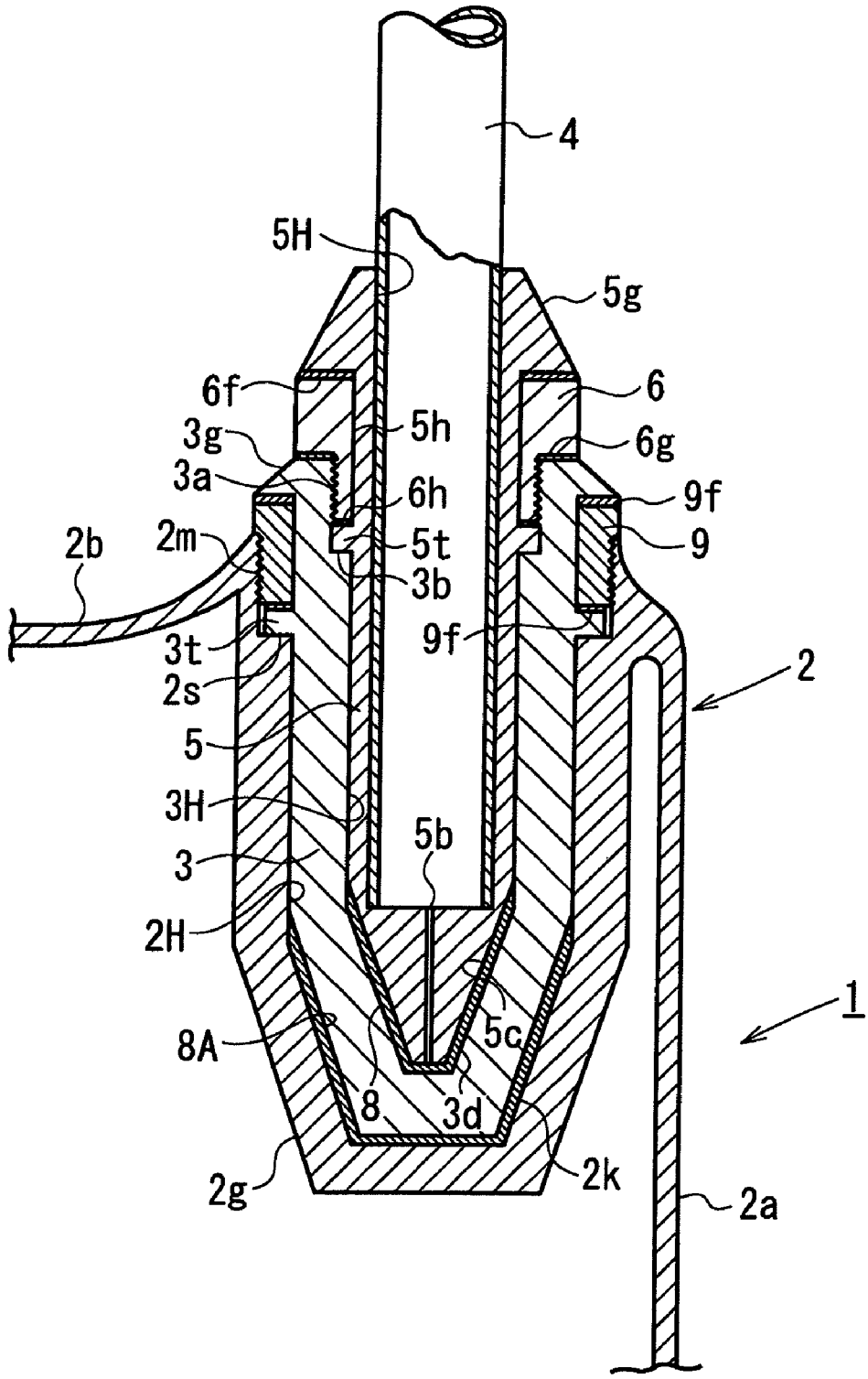
FIG. 5 is a section view taken along the V-V arrow line shown in FIG. 1.
Figure 6:
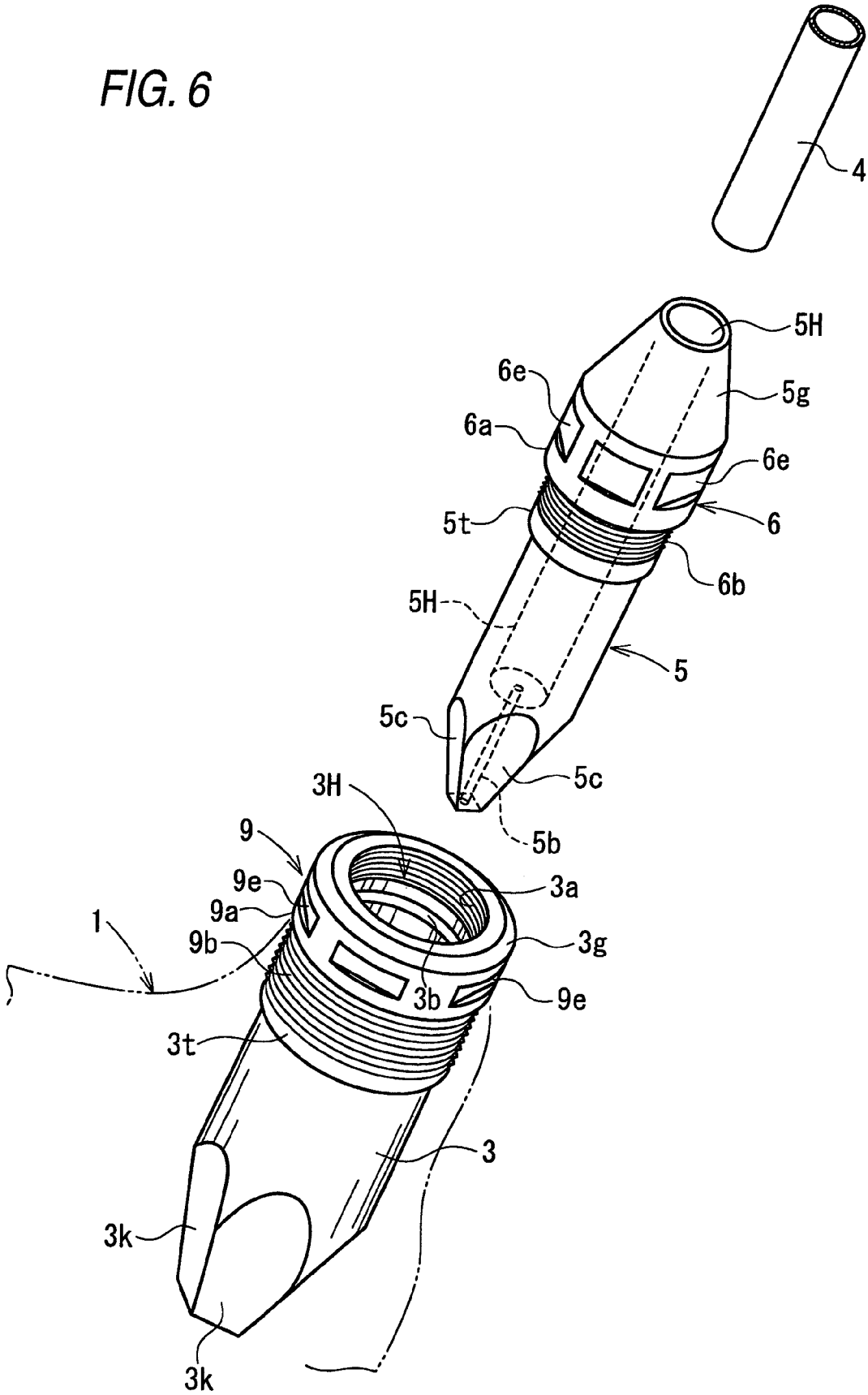
FIG. 6 is a perspective view of the hosel, shaft case and screw member.

As shown in FIGS. 3, 4A, 4B and 8, by using the hosel 3B in which the shaft case insertion hole 3H is set oblique with respect to the axis of the hosel, the inclination of the shaft 4 can be changed from the state shown in FIGS. 1 and 5 to other states (for example, states respectively shown in FIGS. 3, 4A and 4B).

In FIG. 3, the axial line $a_2$ of the shaft 4 is inclined by an angle θ with respect to the axial line $a_1$ of the hosel insertion hole 2H. Therefore, when the hosel 3B is turned by an angle of 90°, 180° or 270°, the inclination direction of the shaft 4 can be changed. In FIG. 4A, the shaft 4 is inclined most toward the heel side. In FIG. 4B, the shaft 4 is inclined most toward the toe side. In FIG. 3, the shaft 4 is inclined most toward the face side.

In this manner, by changing the inclination direction of the shaft 4, the lie angle and slice angle of the shaft 4 can be changed.

Referring to the lie angle, it is smallest in FIG. 4A and it is largest in FIG. 4B, thereby providing an up lie.

Referring to the slice angle, in FIG. 3 where the shaft 4 is inclined most toward the face side, it provides a hook face in which the face surface is closed most. On the other hand, when the shaft 4 is inclined most backwardly (not shown), it provides a slice face in which the face surface is opened most.

In this manner, by using the hosel 3B, the direction of inclination of the shaft 4 with respect to the head 1 can be changed and thus the lie angle and slice angle can be changed.

In this golf club, the increasing diameter portion 5*g* is formed to have a taper shape. However, it may also have a flat flange-like shape and, on the upper portion of such increasing diameter portion, there may be mounted a ferrule.

According to the present embodiment, the second screw member 6 is fitted with the outer surface of the shaft case 5 and is screwed into the hosel 3, 3A or 3B and, when turning the second screw member 6, the second screw member 6 does not come into contact with the shaft 4. This can prevent the shaft 4 against damage.

Here, between the hosel 3, 3A or 3B and hosel insertion hole 2H as well as between the shaft case 5 and shaft case insertion hole 3H, there are interposed thin-piece-shaped elastic members 8A and 8 made of rubber, elastomer, synthetic resin or other similar material, impacts and vibrations generated in the impact time can be absorbed.

According to the present embodiment, the inner surfaces of the hole deep portions of the hosel insertion hole 2H and shaft insertion hole 3H as well as the outer surfaces of the lower end portions of the hosel 3, 3A or 3B and shaft case 5 are respectively formed as inclined surfaces each having a square pyramid shape, and these inclined surfaces are engaged with each other. This can reduce the relative shaking motion of the respective parts and thus can prevent the shaft 4 from turning around its axis. That is, the shaft 4 has high fixing rigidity in the torque direction.

Also, since the four inclined surfaces are formed and the leading end portions of the hosel 3, 3A or 3B and shaft case 5 are thereby formed tapered, the hosel and shaft case can be easily inserted into the hosel insertion hole 2H and shaft case insertion hole 3H respectively.

According to the invention, the shaft of the golf club can be replaced easily. To replace the shaft, to a new shaft to be replaced, there is previously fixed a shaft case of the same type as the above-mentioned shaft case 5 using an adhesive agent. Here, the second screw member 6 is also previously mounted on this shaft case.

The second screw member 6 of an existing golf club is turned to thereby remove an old shaft 4 from the head 1 together with an old shaft case 5 and second screw member 6. Next, the new shaft with a shaft case and screw member connected thereto (a shaft case/shaft connected unit) is inserted into the shaft case insertion hole 3H and the screw member 6 is threadedly engaged with the female screw 3*a*, thereby fixing the new shaft.

In this manner, the mounting and replacement of the shaft can be carried out very simply and quickly. Here, conventionally, to replace a shaft, the hosel portion of an existing golf club is heated to destroy the structure of the hardened matter of the adhesive agent and, after removal of an old shaft, a new shaft is fixed using an adhesive agent; and, therefore, it takes several hours to about one day to replace the shaft. On the other hand, according to the above embodiment of the invention, since the shaft case 5 is previously mounted on a new shaft with an adhesive agent, the shaft can be replaced in several minutes or so. Therefore, it is possible to realize a system in which shafts of several specifications each having a shaft case mounted thereon are previously prepared and thus a golfer can try to hit a ball using the golf club while mounting the different shafts onto the same head main body sequentially.

Here, as the hosel 3B, there may also be previously produced hosels in which the shaft case insertion holes 3H have various kinds of inclination angles θ. For example, as replacing hosels, when there have been previously prepared multiple kinds of hosel groups the above angle θ of which is gradually varied like 0.5°, 1°, 1.5°, 2°, 2.5° and 3°, the above hitting trial can be carried out while changing the lie angle and slice angle gradually.

Figure 9:
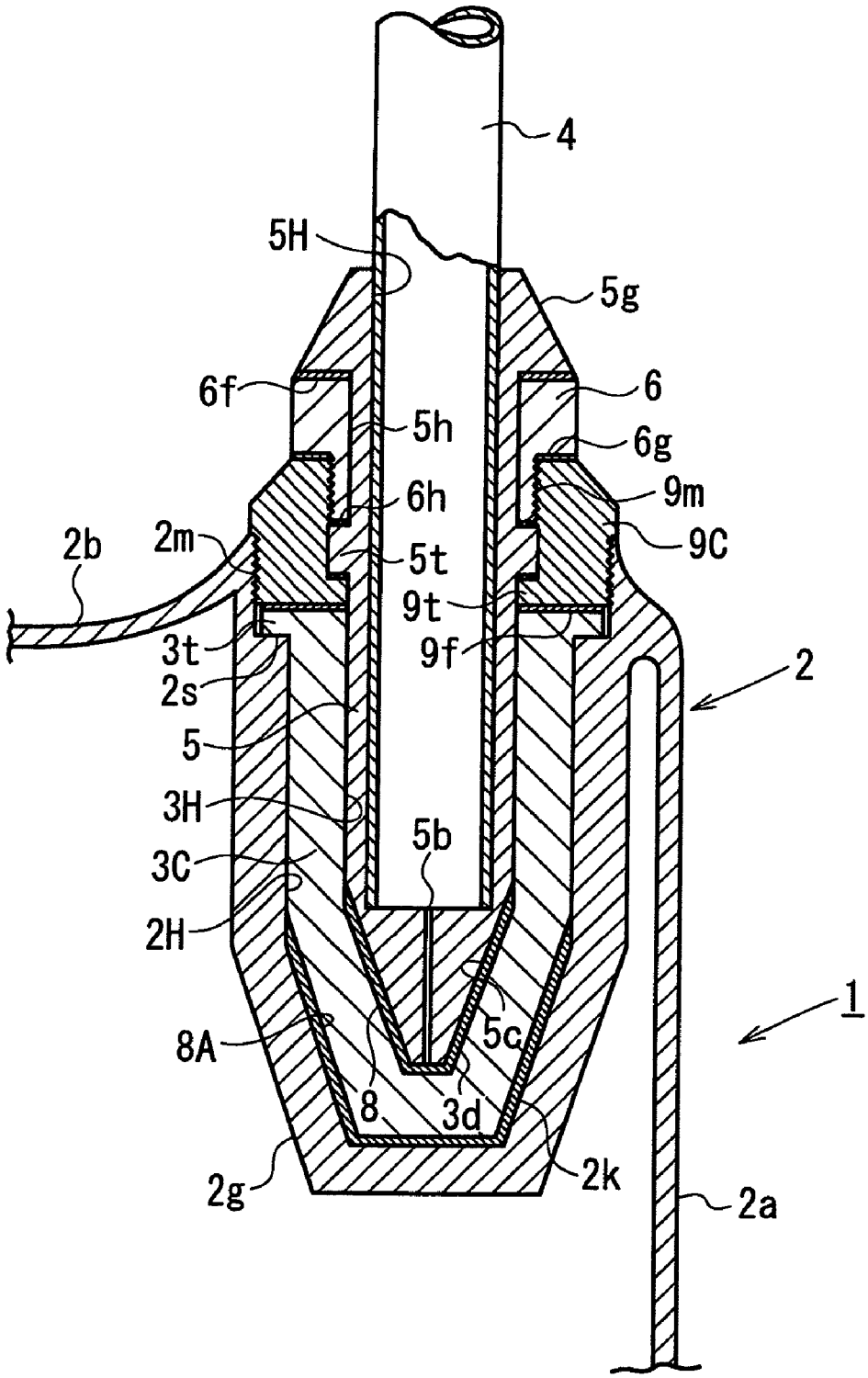
FIG. 9 is a section view of the hosel portion of a golf club head according to a second embodiment of the invention.
Figure 10:
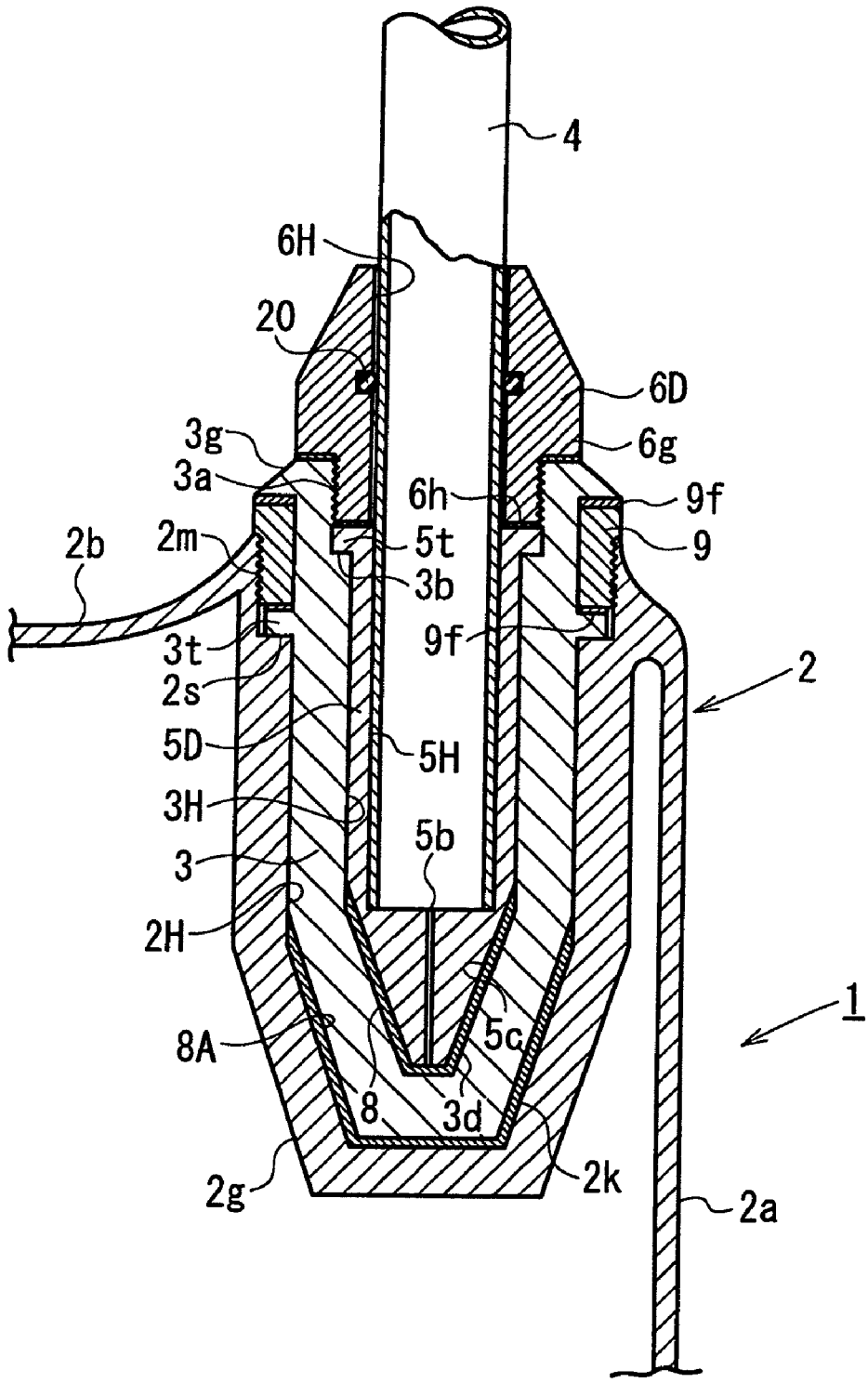
FIG. 10 is a section view of the hosel portion of a golf club head according to a third embodiment of the invention.
Figure 11:
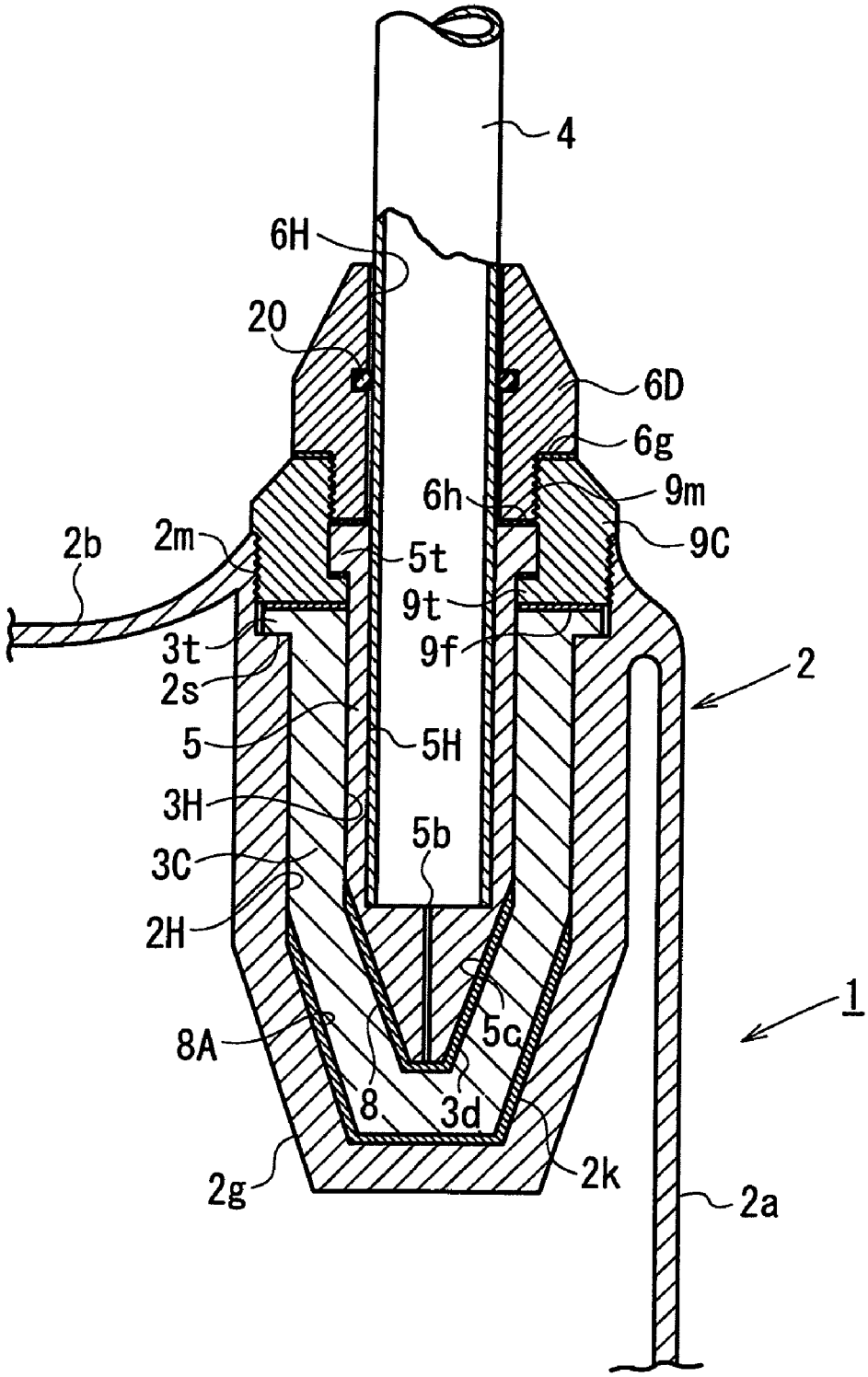
FIG. 11 is a section view of the hosel portion of a golf club head according to a fourth embodiment of the invention.

Now, FIGS. 9 to 11 respectively show the examples of the other structures of the hosel and screw member. Specifically, FIGS. 9 to 11 are respectively section views of such portions of heads according to other embodiments of the invention as are similar to the portion shown in FIG. 5. Therefore, in these embodiments, the same parts thereof as those of the embodiment shown in FIG. 5 are given the same designations.

The embodiment shown in FIG. 9 relates to an embodiment as set forth in Claims 9 and 10. In this embodiment, instead of the hosel 3, there is used a short hosel 3C formed by cutting such portions of the hosel 3 as existing upwardly of the projecting portion 3*t*. Of the hosel 3, the portions existing upwardly of the projecting portion 3*t* are replaced with a first screw member 9C. That is, the first screw member 9C is a combined member of the first screw member 9 shown in FIG. 5 and the portions of the hosel 3 existing upwardly of the projecting portion 3*t*.

In the inner peripheral surface of the upper portion of the first screw member 9C, there is formed a female screw 9*m* equivalent to the above-mentioned female screw 3*a* and, into this female screw 9*m*, there is threadedly engaged the male screw 6*b* (in FIG. 9, the designation thereof is omitted. See FIG. 6) of the second screw member 6. On the inner peripheral surface of the lower portion of the first screw member 9C, there is provided a projecting portion 9*t* in such a manner that it extends around such inner peripheral surface, while the projecting portion 5*t* of the shaft case 5 is contacted with the projecting portion 9*t* through a spacer.

When the first screw member 9C is screwed into the female screw 2*m*, the hosel 3C can be fixed. When the male screw 6*b* of the second screw member 6 is threadedly engaged into the female screw 9*m* of the first screw member 9C, the projecting portion 5*t* of the shaft case 5 is pressed against the projecting portion 9*t* of the second screw member 9C to thereby fix the shaft case 5 to the hosel 3C. The other remaining structures of the present embodiment are the same as in the embodiment shown in FIGS. 1 to 8.

In FIG. 10, there is used a shaft case 5D which can be produced by cutting such portions of the shaft case 5 as existing upwardly of the projecting portion of the shaft case 5. As a second screw member 6D, there is used a combined member of the second screw member 6 shown in FIG. 5 and the portions of the shaft case 5 existing upwardly of the projecting portion 5*t*. The shaft 4 is inserted through the shaft insertion hole 6H of the second screw member 6D into the shaft insertion hole 5H of the shaft case 5D. The shaft 4 is bonded to the inner peripheral surface of the shaft insertion hole 5H of the shaft case 5D with an adhesive agent. The second screw member 6D is rotatably fitted with the outer surface of the shaft 4. On the inner peripheral surface of the shaft insertion hole 6H, there is provided an O ring 20 which is slidably contacted with the outer peripheral surface of the shaft 4, thereby preventing the shaking motion of the shaft 4. The other remaining structures of the embodiment shown in FIG. 10 are the same as the embodiment shown in FIGS. 1 to 8.

FIG. 11 shows an embodiment structured such that, in FIG. 10, the hosel 3 and first screw member 9 are replaced with the hosel 3C and first screw member 9C respectively shown in FIG. 9. The other remaining structures of this embodiment are the same as the embodiment shown in FIG. 10.

The embodiments respectively shown in FIGS. 9 to 11 can also provide similar operation effects to the embodiment shown in FIGS. 1 to 8.

The above-mentioned hosel, shaft case and screw member may preferably be made of metal, more preferably, aluminum, or titanium, or an alloy thereof. The hosel 3, 3A, 3B and 3C may preferably be made of material the specific gravity of which is equivalent to or lower than the material of the head main body. Specifically, they may be made of, for example, a titanium alloy, aluminum, an aluminum alloy, a magnesium alloy, FRP and synthetic resin. Further, they may be made of a material treated by an alumite treatment.

The material of the head is not limited to a specific one but, for a wood type golf club, there can be used a titanium alloy, an aluminum alloy, or stainless steel.

According to the above embodiments, in the hosel and hosel insertion hole, there are formed four inclined surfaces which can provide a regular square pyramid shape. However, there may also be provided a regular polygonal pyramid shape in which the number of inclined surfaces is three or five or more. Also, the leading end portion of the hosel and the deep portion of the hosel insertion hole may also be formed to have a section of a recessed polygonal shape such as a star shape, or a section of a gear teeth shape. Further, it may be V-shaped structure.

Here, as a grip to be mounted on the shaft 4, in some cases, there is used a grip the section of which is formed not a complete circle. For example, of the outer peripheral surface of the grip, the lower side surface directed to the ground when the golf club is positioned for hitting a ball is expanded from the other remaining surfaces of the grip. In this case, however, there is a fear that, when the direction of the hosel 3, 3A, 3B, or 3C is changed, the grip expanded portion cannot provide the ground side. In view of this, according to the invention, preferably, there may be used a grip the section of which has a complete circle.

Although, in the above embodiments, the golf club head is of a wood type, the invention can also be applied to golf club heads of any types including a utility type, an iron type, a patter type and the like.

Here, in the hollow type golf club head shown in the drawings, due to provision of the hosel 3, 3A, 3B or 3C, hosel installation portion 2*g*, shaft case 5 and screw member 6, 6D, 9 or 9C, the heel side weight thereof is greater than that of an ordinary golf club head. In view of this, by increasing the thickness of the toe side or back portion thereof or by providing a weight on the toe side thereof, the golf club head may be balanced well.

What is claimed is:

1. A golf club, comprising:

a golf club head including:

a head main body, formed with a hosel insertion hole;

a hosel, formed with a shaft case insertion hole and removably mounted in the hosel insertion hole; and a shaft case, formed with a shaft insertion hole and removably mounted in the shaft case insertion hole;

a shaft, wherein a leading end of the shaft is inserted into and fixed to the shaft insertion hole;

a first female screw, formed in an inner peripheral surface of an entrance portion of the hosel insertion hole;

a first screw member; and a first male screw, formed in an outer peripheral surface of the first screw member, the first male screw being fitted with an outer surface of the hosel so that the first screw member is rotatably attached and is prevented from moving in an axial direction of the first screw member, wherein the first male screw is threadedly engaged with the first female screw to fix the hosel to the head main body.

2. The golf club according to claim 1, wherein the shaft is set concentric with the shaft case insertion hole.

3. The golf club according to claim 1, wherein the shaft is set concentric with the hosel insertion hole.

4. The golf club according to claim 1, wherein the shaft is inserted into the shaft insertion hole of the shaft case and is fixed with an adhesive agent.

5. The golf club according to claim 1, wherein a lower end portion of the hosel has a polygonal-shaped section, and the deep portion of the hosel insertion hole has a section adapted to engage with the lower end portion of the hosel.

6. The golf club according to claim 5, wherein an elastic member, interposed between the lower end portion of the hosel and an inner surface of the deep portion of the hosel insertion hole.

7. A golf club comprising:

a golf club head including:

a head main body, formed with a hosel insertion hole;

a hosel, formed with a shaft case insertion hole and removably mounted in the hosel insertion hole; and a shaft case, formed with a shaft insertion hole and removably mounted in the shaft case insertion hole;

a shaft, wherein a leading end of the shaft is inserted into and fixed to the shaft insertion hole;

a first female screw, formed in an inner peripheral surface of an entrance portion of the hosel insertion hole;

a first screw member;

a first male screw, formed in an outer peripheral surface of the first screw member, the first male screw being fitted with an outer surface of the hosel so that the first screw member is rotatably attached and is prevented from moving in an axial direction of the first screw member, a second female screw, formed in an inner peripheral surface of an entrance portion of the shaft case insertion hole;

a second screw member; and a second male screw, formed in an outer peripheral surface of the second screw member, a second screw member being fitted with an outer surface of the shaft case so that the second screw member is rotatably attached and is prevented from moving in an axial direction of the second screw member, wherein the first male screw is threadedly engaged with the first female screw to fix the hosel to the head main body wherein the second male screw is threadedly engaged with the second female screw to fix the shaft case to the hosel.

8. The golf club according to claim 7, wherein the shaft is set concentric with the shaft case insertion hole.

9. The golf club according to claim 7, wherein the shaft is set concentric with the hosel insertion hole.

10. The golf club according to claim 7, wherein the shaft is inserted into the shaft insertion hole of the shaft case and is fixed with an adhesive agent.

11. The golf club according to claim 7, wherein a lower end portion of the hosel has a polygonal-shaped section, and the deep portion of the hosel insertion hole has a section adapted to engage with the lower end portion of the hosel.

12. The golf club according to claim 11, wherein an elastic member, interposed between the lower end portion of the hosel and an inner surface of the deep portion of the hosel insertion hole.

* * * * *